United States Patent [19]

Mitchell et al.

[11] Patent Number: 4,758,258

[45] Date of Patent: Jul. 19, 1988

[54] PROCESS FOR RECOVERING HELIUM FROM A NATURAL GAS STREAM

[75] Inventors: E. Keith Mitchell, Shawnee; Donald N. Reed; Thomas L. Rodkey, both of Edmond, all of Okla.

[73] Assignee: Kerr-McGee Corporation, Oklahoma City, Okla.

[21] Appl. No.: 46,315

[22] Filed: May 6, 1987

[51] Int. Cl.[4] ..... F25J 3/02

[52] U.S. Cl. ..... 62/25; 62/27; 62/29; 62/33; 62/39

[58] Field of Search ..... 62/9, 11, 22, 23, 24, 62/25, 27, 29, 30, 32, 33, 36, 38, 39

[56] References Cited

U.S. PATENT DOCUMENTS

| | | | |
|---|---|---|---|
| 3,512,368 | 5/1970 | Harper | 62/27 X |
| 3,740,962 | 6/1973 | Fan | 62/30 X |
| 3,805,537 | 4/1974 | Forg et al. | 62/22 |
| 4,305,733 | 12/1981 | Scholz et al. | 62/27 X |
| 4,312,652 | 1/1962 | Mikulla | 62/29 |

OTHER PUBLICATIONS

Kirk-Othmer *Encyclopedia of Chemical Technology*, vol. 10, pp. 872–873, 2ed (1966).

"Helium Production at the Bureau of Mines Keyes, Okla. Plant" by W. M. Deaton and R. D. Hayes and appearing in *Bureau of Mines Information Circular*, IC 8018 (1966).

"A New Approach to Helium Recovery" appearing in Kellogram, pp. 4–5, Issue No. 3, (M. W. Kellogg Co., 1963).

Perry's *Chemical Engineering Handbook*, Section 12, pp. 29–30, 4th Ed. (1963).

*Primary Examiner*—Steven E. Warner

*Attorney, Agent, or Firm*—William G. Addison; John P. Ward

[57] ABSTRACT

An improved process for cryogenically separating a helium-bearing natural gas stream comprising subjecting the natural gas stream to a sequence of alternating cooling and separating steps wherein one or more process-derived streams are utilized to effect cooling of the natural gas streams to temperatures in the cryogenic range. The process provides for the separation and recovery of a natural gas liquids product stream consisting substantially of condensed $C_2$ and higher hydrocarbons and a gaseous product stream consisting of at least 50 volume percent of helium with the balance being substantially nitrogen.

12 Claims, 1 Drawing Sheet

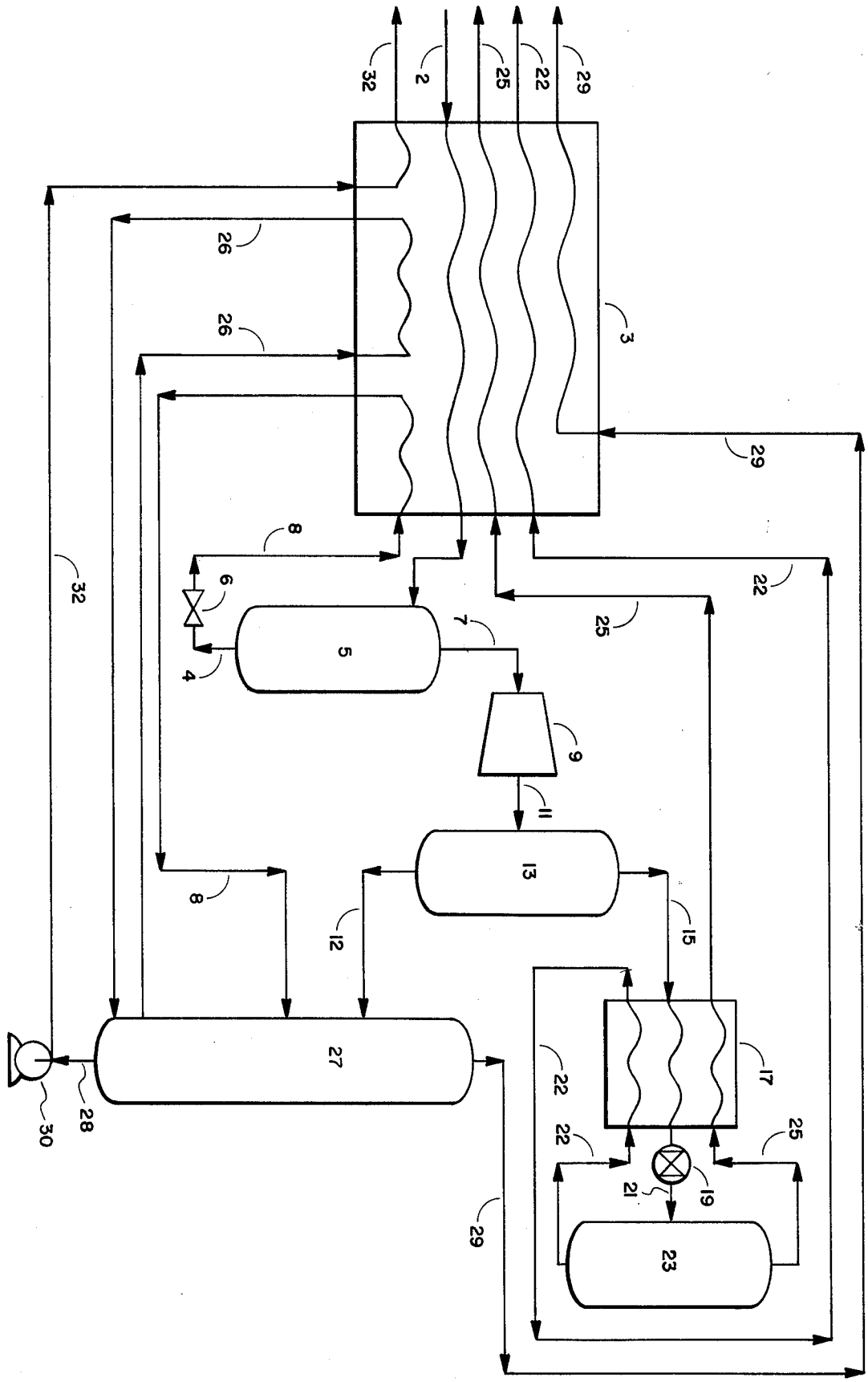
29
22
25
2
32
3
29
22
25
26
26
32
8
6
4
5
7
9
11
13
12
15
8
27
28
30
17
22
22
25
21
19
23
29

PROCESS FOR RECOVERING HELIUM FROM A NATURAL GAS STREAM

FIELD OF THE INVENTION

The present invention relates to an improved process for cryogenically separating helium from helium-bearing natural gases. More particularly, the present invention relates to an improved process for cryogenically separating a helium-bearing natural gas for the recovery therefrom of a gaseous product stream comprised of at least 50 volume percent of helium with the balance of the product stream comprising nitrogen.

BACKGROUND OF THE INVENTION

The recovery of helium from helium-bearing natural gases by processes based upon the use of cryogenic techniques is known. Such processes basically consist of subjecting a helium-bearing natural gas to successively lower temperatures to condense and thereby remove from the natural gas those components therein having boiling points higher than that of helium. These components generally include, in descending order of their boiling points, hydrocarbons heavier than methane, methane itself and nitrogen.

In general, these known processes comprise at least three distinct operative steps or stages. These include (1) a preliminary gas treatment step for the removal of water, carbon dioxide and hydrogen sulfide, (2) a natural gas liquids separation step using low but noncryogenic temperatures and (3) a crude helium product separation step employing cryogenic temperatures, said product containing at least 50 volume percent of helium. When a pure helium product is desired a fourth step or stage will be integrated into the process to substantially reject nitrogen from the crude helium product. A general description of two known processes for cryogenically separating and recovering either crude or pure helium from helium-bearing natural gases is provided in Kirk-Othmer *Encyclopedia of Chemical Technology,* Vol. 10, pp 872–873, 2ed (1966). More detailed descriptions of the two processes described in the Kirk-Othmer reference are provided in the article "Helium Production At The Bureau Of Mines Keyes, Okla. Plant" by W. M. Deaton and R. D. Hayes, *Bureau of Mines Information Circular,* IC 8018 (1966) and in the article "A New Approach to Helium Recovery" appearing in *Kellogram,* pp 4–5, Issue No. 3 (M. W. Kellogg Co., 1963).

As is clear from a review of the above references, some of the required refrigeration employed in the processes is obtained through the use of expansion, i.e., the Joule-Thomson cycle, and indirect heat exchange. However, it also is clear from a review of these references that to attain the lowest temperatures (i.e., cryogenic temperatures) required in these processes, integrated but independent and separate liquefaction cycles (i.e., refrigeration) using e.g., methane or nitrogen as working fluids must be employed. The need for such auxiliary refrigeration contributes not only to an increase in the initial capital costs for helium extraction plants embodying these processes but also to an increase in both operating and maintenance costs for such facilities. Thus, a process for the separation and recovery of a crude helium product from a helium-bearing natural gas in which auxiliary refrigeration was not required to achieve the cryogenic temperatures necessary to the separation would represent an advancement over these known processes.

SUMMARY OF THE INVENTION

It now has been discovered that helium-bearing natural gases can be cryogenically separated to recover therefrom a crude helium product without the use of auxiliary cryogenic refrigeration. In accordance with this discovery the present invention provides a process for the separation of helium-bearing natural gases into at least four distinct process-derived streams including a natural gas liquids stream, a condensed residue gas stream, a vaporous residue gas stream and a crude helium stream. The process utilizes indirect heat exchange, expansion or a combination thereof as the sole means to provide the cryogenic operating temperatures required for the separation.

Broadly, the process of this invention consists of a series of manipulative steps or stages wherein the helium contained in a helium-bearing natural gas is concentrated through the step-wise removal of those components in the natural gas having boiling points higher than that of helium. Specifically, the process of this invention consists of first cooling a helium-bearing natural gas feed stream by means of indirect heat exchange with one or more of the above disclosed process-derived streams alone, or in combination with heat exchange media provided by auxiliary, noncryogenic refrigeration means. This cooling effects a condensation of at least a portion of the methane and a substantial portion of the condensable $C_2$ and higher hydrocarbon components contained in said natural gas. The cooled, partially condensed natural gas feed stream is introduced into a first fractionation zone wherein a first vaporous phase comprised of helium, nitrogen, and a remaining balance of both the methane and the condensable $C_2$ and higher hydrocarbon compounds contained in the original natural gas feed stream is separated therefrom. Also separated from the cooled, partially condensed natural gas feed is a first liquid phase effluent stream comprised of the condensed portion of said methane and the condensed substantial portion of the condensable $C_2$ and higher hydrocarbon compounds.

The first vaporous phase separated from the cooled, partially condensed natural gas feed stream in the first fractionation zone is withdrawn therefrom and cooled by means selected from either indirect heat exchange with one or more of the above process streams or expansion, or a combination thereof, to temperatures in the cryogenic range (i.e., temperatures of minus 100° C. and below). Cooling of this first vaporous phase to temperatures in the cryogenic rane effects a further condensation of a major portion of the remaining balance of the methane and the remaining portion of the condensable $C_2$ and higher hydrocarbon compounds contained in the first vaporous phase. The cooled first vaporous phase then is introduced into a second fractionation zone wherein a second vaporous phase comprised of helium, nitrogen and a remaining minor balance of the methane is separated therefrom providing a second liquid phase effluent stream. This second liquid phase effluent stream is comprised of a condensed major portion of the remaining balance of the methane and the condensed remaining portion of the condensable $C_2$ and higher hydrocarbon compounds.

In a final step of the process of this invention, the above second vaporous phase is withdrawn from said second fractionation zone, further cooled by means of indirect heat exchange with one or more of the above disclosed process-derived streams to condense the remaining minor portion of the remaining balance of the methane and a portion of the nitrogen in the second vaporous phase. The cooled and condensed second vaporous phase then is reduced in pressure and introduced into a third fractionation zone wherein a third vaporous phase, comprising a gaseous product stream consisting essentially of at least 50 volume percent of helium, the balance being substantially nitrogen, is separated and recovered therefrom. Separation of the second vaporous phase in this third fractionation zone produces a third liquid phase effluent stream comprising a condensed residue gas product stream consisting of the condensed remaining minor portion of the remaining balance of the methane and a major portion of the nitrogen contained in the second vaporous phase.

The process of the present invention also contemplates the processing of said first and second liquid phase effluent streams produced in and recovered from the first and second fractionation zones to produce a natural gas liquids product stream and a vaporous residue gas product stream.

DESCRIPTION OF THE DRAWING

The single FIGURE is a schematic view illustrating the general flow of materials in the process of the present invention including the processing of the various liquid effluent streams produced in the process.

DETAILED DESCRIPTION OF THE PREFERRED EMBODIMENT

With reference to the single FIGURE, the present invention consists of an improved process for cryogenically separating and recovering from a helium-bearing natural gas a crude helium gaseous product stream comprising at least 50 volume percent of helium, the balance of said product stream being substantially nitrogen. Helium bearing natural gases to which the process of the present invention is applicable are those natural gases which contain, for example, helium, nitrogen, methane and condensable $C_2$ and higher hydrocarbon compounds. The process of the present invention further provides for the separation and recovery of additional useful product streams including, for example, a natural gas liquids product stream and both condensed and vaporous residue gas product streams.

In accordance with the improved process of the present invention, an initial helium-bearing natural gas, received at an elevated temperature ranging from about 10° C. to about 50° C. and at an elevated pressure ranging from about 400 pounds per square inch guage (psig) to about 4000 psig and pretreated (by means not shown) to remove water, carbon dioxide and hydrogen sulfide, if any, is conveyed via a conduit 2 through an indirect heat exchange zone 3 to a first fractionation zone 5. Within indirect heat exchange zone 3, which can comprise one or more indirect heat exchange means such as, for example, fin and tube, shell and tube and plate-type heat exchangers and the like, the pretreated helium-bearing natural gas is brought into indirect heat exchange contact with at least one process-derived product stream media. Heat exchange media which can be employed within indirect heat exchange zone 3 consist, in the main, of the above mentioned crude helium gaseous product stream and both of the condensed and vaporous residue gas product streams or combinations of these streams with heat exchange media provided by auxiliary, non-cryogenic refrigeration means (not shown). Other process-derived streams, disclosed and described hereinbelow, also may be employed as heat exchange media within indirect heat exchange zone 3.

As the pretreated helium-bearing natural gas is conveyed via conduit 2 through indirect heat exchange zone 3 to first fractionation zone 5 it is cooled to a temperature sufficient to effect a condensation of at least a portion of the methane and a substantial portion of the condensable $C_2$ and higher hydrocarbon compounds contained in the natural gas. In particular, the helium-bearing natural gas undergoing processing in accordance with the present invention will be cooled to a temperature in the range of from about minus 20° C. to about minus 120° C. Reduction of the temperature of the helium-bearing natural gas to a temperature within this range results in condensation of at least a portion, i.e., from about 1.0 volume percent to about 75 volume percent, of the methane and a substantial portion, i.e., from about 40 volume percent to about 99 volume percent, of the condensable $C_2$ and higher hydrocarbon compounds present therein.

The cooled, helium-bearing natural gas, having condensed therein at least a portion of the methane and a substantial portion of the condensable $C_2$ and higher hydrocarbon compounds, is introduced into first fractionation zone 5 which can comprise one or more conventional packed or plate towers, or simple flash towers or flash chambers. The cooled helium-bearing natural gas is subjected to separation within said first fractionation zone 5 to provide a first liquid phase effluent stream comprising the condensed portion of the methane and the condensed substantial portion of the $C_2$ and higher hydrocarbon compounds and a first vaporous phase stream comprising the helium, nitrogen, the remaining balance of the methane and the condensable $C_2$ and higher hydrocarbon compounds. The portions or percentages of the condensed methane and $C_2$ and higher hydrocarbon compounds in this first liquid phase effluent stream are, of course, the same portions or percentages disclosed above for the extent of condensation which occurs when cooling of the pretreated helium-bearing natural gas within indirect heat exchange zone 3. Thus, the first liquid phase effluent stream comprises from about 1.0 to about 75 volume percent of the methane and from about 40 to about 99 volume percent of the condensable $C_2$ and higher hydrocarbon compounds.

By difference, the first vaporous phase stream separated within first fractionation zone 5 will comprise from about 25 to about 99 volume percent of the amount of methane present in the initial pretreated helium-bearing natural gas and from about 1 to about 60 volume percent of the $C_2$ and higher hydrocarbon compounds.

Each of said first liquid phase effluent stream and said first vaporous phase stream is withdrawn, individually, from said first fractionation zone 5 by a conduit 4 and a conduit 7, respectively. The first vaporous phase stream is conveyed through the conduit 7, an expansion zone 9 and a conduit 11 to a second fractionation zone 13. The conveyance of the first vaporous phase stream through the expansion zone 9 effects a reduction in the pressure of this first vaporous phase stream to a value in the range of from about 120 psig to about 450 psig. This reduction in pressure also causes a concomitant reduction in the temperature of the first vaporous phase stream to a temperature in the range of from about minus 60° C. to about minus 155° C. It is this reduction in temperature brought about by the reduction in pressure which is the primary purpose of the expansion zone 9.

In an alternative embodiment, cooling of the first vaporous phase can be accomplished by using an indirect heat exchange means (not shown) such as described hereinabove in place of the expansion zone 9 illustrated in the FIGURE. In this alternative embodiment, various process-derived streams, and particularly the process-derived product streams such as the above mentioned crude helium gaseous product stream and the condensed and vaporous residue gas streams, will be employed as heat transfer media to cool the first vaporous phase stream to temperature within the range specified above. However, the preferred means for accomplishing this cooling is by way of the expansion zone 9 as illustrated in the single FIGURE. In general, the expansion zone 9 can comprise a conventional expansion engine of either the piston or turbine-type as briefly described in Perry's *Chemical Engineering Handbook*, Section 12, pages 29–30, 4th Ed. (1963) or simple throttle valve.

This reduction in temperature of the first vaporous phase stream as a result of either reducing the pressure of said stream within the expansion zone 9 or by indirect heat exchange of said stream with one or more of the process-derived product streams causes condensation of a major portion of the remaining balance of the methane and the remaining balance of the condensable $C_2$ and higher hydrocarbon compounds. Specifically, said cooling leads to the condensation of from about 45 to about 85 volume percent of the remaining balance of the methane and from about 99 to 100 percent of the remaining balance of the condensable $C_2$ and higher hydrocarbon compound contained in the first vaporous phase stream.

Subsequent to cooling and condensation of the first vaporous phase stream in the expansion zone 9 it is conveyed via the conduit 11 to the second fractionation zone 13. Second fractionation zone 13 can comprise a single vessel or multiple vessels arranged and operated in series. Such vessel or vessels can all be of the same types as described for use in the first fractionation zone 5, i.e., conventional packed or plate towers, or simple flash towers or chambers.

Within the second fractionation zone 13, the cooled and condensed first vaporous phase stream is separated to provide a second liquid phase effluent stream and a second vaporous phase stream. This second liquid phase effluent stream is comprised of a condensed major portion of the remaining balance of the methane and the condensed remaining balance of the condensable $C_2$ and higher hydrocarbon compounds. This second liquid phase effluent stream is withdrawn via a conduit 12 from the second fractionation zone 13 and conveyed via said conduit 12 to a fourth fractionation zone 27. The second vaporous phase stream is comprised of helium, nitrogen and a remaining minor portion of the remaining balance of the methane and is withdrawn from the second fractionation zone 13 by way of a conduit 15 and conveyed thereby through an indirect heat exchange zone 17, a valve 19 and a conduit 21 and to a third fractionation zone 23. Within the indirect heat exchange zone 17, which utilizes both the process-derived gaseous product stream and the process-derived condensed residue gas stream as heat transfer media, the second vaporous phase stream is cooled to a temperature ranging from about minus 170° C. to about minus 205° C. This cooling effects a condensation of the remaining minor portion of the remaining balance of the methane and a major portion of the nitrogen present in this vaporous phase stream. In general, this cooling of the second vaporous phase stream results in the condensation of from about 99 to about 100 volume percent of the remaining balance of the methane and from about 50 to about 100 volume percent of the nitrogen present therein.

The pressure of the cooled, second vaporous phase stream is reduced to a pressure ranging from about atmospheric pressure to about 150 psig by means of the valve 19. The cooled and reduced pressure second vaporous phase stream then is introduced into the third fractionation zone 23. Third fractionation zone 23 also can comprise a single vessel or multiple vessels arranged and operated in series. Such vessel or vessels also can be of the same types as described for use in the first fractionation zone 5, i.e., conventional packed or plate towers or simple flash towers or flash chambers.

Within the third fractionation zone 23, the cooled and reduced pressure second vaporous phase stream is separated into a third vaporous phase stream and a third liquid phase effluent stream. This third vaporous phase stream comprises the gaseous product stream and consists essentially of at least about 50 volume percent of helium with the balance being substantially nitrogen. The third liquid phase effluent stream comprises the condensed residue gas stream consisting essentially of the remaining minor portion of the remaining balance of the methane and a major portion of the nitrogen present in the second vaporous phase stream.

The third liquid phase effluent (or condensed residue gas) stream and the third vaporous phase or gaseous product stream are withdrawn individually from the third fractionation zone 23 by way of conduits 22 and 25, respectively. Each of these process streams are employed in the process of the present invention as heat exchange (or refrigerant) media and are conveyed through the conduits 22 and 25 respectively to both of the indirect heat exchange zones 3 and 17 for use as refrigerants therein as well as in the indirect heat exchange means substituted for expansion zone 9 in accordance with the alternative embodiment described hereinabove. The temperatures of these process-derived streams are sufficiently low, i.e., between about minus 170° C. and about minus 205° C., to provide at least a portion of the refrigeration needs of the process of this invention thereby eliminating the need for auxiliary refrigeration means to achieve cryogenic temperatures.

Although the third liquid phase effluent stream (or condensed residue gas) stream withdrawn from the third fractionation zone 23 by way of conduit 22 generally will be employed as heat exchange (or refrigerant) media within indirect heat exchange zones 3 and 17 and finally recovered as a process-derived process stream as disclosed hereinabove, this third liquid phase effluent stream can itself be further separated. Thus, in an additional embodiment of this invention, the third liquid phase effluent stream is withdrawn via conduit 22 from the third fractionation zone 23 and conveyed, or at least a portion thereof conveyed, to a fifth fractionation zone (not shown).

Within the fifth fractionation zone the third liquid phase effluent stream is separated into a fifth liquid phase effluent stream and a fifth vaporous phase stream.

The fifth liquid phase effluent stream will comprise from about 90 to about 100 volume percent of methane and from about 0 to about 10 volume percent of nitrogen and is withdrawn, by way of a conduit (not shown), from a lower portion of the fifth fractionation zone. The fifth vaporous phase stream will comprise from about 0 to about 10 volume percent of methane and from about 90 to about 100 volume percent of nitrogen and is withdrawn, by way of a conduit (not shown), from an upper portion of the fifth fractionation zone. The operating conditions for effecting the separation of the third liquid phase effluent stream within the fifth fractionation zone include temperatures ranging from about minus 120° C. to about minus 205° C. and pressures ranging from about atmospheric pressure to about 150 psig.

The temperature of these process-derived streams are sufficiently low to make them useful as heat exchange media and thereby provide a further portion of the refrigeration requirements of the process of this invention. For example, the fifth liquid phase effluent stream withdrawn from the lower portion of the fifth fractionation zone will have a temperature ranging from about minus 120° C. to about 170° C. while the temperature of the fifth vaporous phase stream withdrawn from the upper portion of said fifth fractionation zone will range from about minus 140° C. to about minus 205° C. Thus, both of these process-derived streams can be conveyed directly to either or both indirect heat exchange zones 3 and 17 for use therein as heat exchange media.

In addition to its use as a heat exchange media in indirect heat exchange zones 3 and 17, the fifth vaporous phase stream can also be employed to provide internal reflux for the third liquid phase effluent stream undergoing separation within the fifth fractionation zone. When also used for this purpose, the fifth vaporous phase first will be further cooled to a temperature in the range of from about minus 190° C. to about minus 205° C. by reducing the pressure thereon to a value ranging from about atmospheric to about 20 psig. This pressure reduction can be carried out in a second expansion zone (not shown) in fluid communication with the fifth fractionation zone. In the practice of this embodiment of the invention, the fifth vaporous phase stream will be withdrawn from the upper portion of the fifth fractionation zone, cooled in the second expansion zone, conveyed to the upper portion of the fifth fractionation zone and through an indirect heat exchange means located therein. The fifth vaporous phase stream, which now is at a temperature ranging from about minus 150° C. to about minus 190° C., then is withdrawn from the heat exchange means located in the upper portion of the fifth fractionation zone by a conduit in fluid communication therewith and conveyed to heat exchange zones 3 and 17. The methane rich fifth liquid phase effluent stream then is recovered as a further process-derived product stream while the nitrogen rich fifth vaporous phase which is low in fuel value generally will be discarded.

Means suitable for use as the fifth fractionation zone and the second expansion zone include those same means described hereinabove for the first fractionation zones 5, 13, 23 and 27 and the first expansion zone 9. The heat exchange means located in the upper portion of the fifth fractionation zone for purposes of providing internal reflux for separating the third liquid phase effluent stream in this fractionation zone can include, for example, a simple coiled conduit, a fin and tube-type heat exchanger, and the like.

The process of the present invention also is capable of producing further useful product streams including a natural gas liquids product stream and a vaporous residue gas stream. Referring once again to the single FIGURE, both the first and second liquid phase effluent streams withdrawn from the first fractionation zone 5 and the second fractionation zone 13 are introduced into the fourth fractionation zone 27. Fourth fractionation zone 27 also can comprise one or more vessels in series, said vessel or vessels being of the conventional packed or plate tower-type, or simple flash towers or chambers as described hereinabove. The first liquid phase effluent stream is withdrawn from the first fractionation zone 5 via the conduit 4 and is conveyed to the fourth fractionation zone 27 through said conduit 4, a valve 6 and a conduit 8. Conduit 8 is passed through indirect heat exchange zone 3 and in heat exchange proximity to the conduit 2 whereby a portion of the heat necessary for the separation to be carried out in the fourth fractionation zone 27 is transferred to the first liquid phase effluent stream. The second liquid phase effluent stream is withdrawn from the second fractionation zone 13 via the conduit 12 and is conveyed through said conduit 12 directly to the fourth fractionation zone 27. In the fourth fractionation zone 27 the components in the first and second liquid phase effluent streams are separated into a fourth liquid phase effluent streams are a fourth vaporous phase stream. This separation is conducted at temperatures ranging from about minus 120° C. to about plus 150° C. and pressures ranging from about 120 psig to about 450 psig.

As noted hereinabove, a portion of the heat necessary to provide the above separation temperatures is provided by conveying the first liquid phase effluent stream via the conduit 8 through the indirect heat exchange zone 3 and in indirect heat exchange relationship with the incoming pretreated helium-bearing natural gas flowing through the conduit 2. The remainder of the heat necessary to provide the above temperatures within the fourth fractionation zone 27 is by the removal of a side stream of the fourth liquid phase effluent collected in the bottom portion of said fourth fractionation zone 27. This side stream is withdrawn from the fourth fractionation zone 27 by way of a conduit 26 which is passed through indirect heat exchange zone 3 and in heat exchange proximity to the conduit 2 and back to the fourth fractionation zone 27. As the side stream of the fourth liquid phase effluent flows through the conduit 26 it is heated by indirect heat exchange with the incoming pretreated helium-bearing natural gas flowing through conduit 2. The heat provided by the incoming helium-bearing natural gas to this side stream as well as the heat provided to the first liquid phase effluent stream flowing in the conduit 8 is sufficient to give the temperatures disclosed above for use in the fourth fractionation zone 27.

The fourth liquid phase effluent stream produced in the fourth fractionation zone 27 comprises a natural gas liquids product stream. This stream consists of a condensed minor portion of the methane and a condensed substantial portion of the condensable $C_2$ and higher hydrocarbon compounds and is withdrawn and recovered from the fourth fractionation zone 27 via a conduit 28, a pump 30 and a conduit 32. The fourth vaporous phase stream produced in the fourth separation zone 27 comprises a vaporous residue gas stream consisting of a remaining balance of the total methane present in the first and second liquid phase effluent streams combined.

This process stream is withdrawn and recovered from the fourth fractionation zone 27 via a conduit 29, which conduit 29 in turn passes through the indirect heat exchange zone 3. By passing the conduit 29 through the indirect heat exchange zone 3, the vaporous residue gas stream flowing therethrough provides additional cooling for the incoming pretreated helium-bearing natural gas stream.

While the process of the present invention has been described with respect to that which at present is believed to be the preferred embodiments, it is to be understood that changes and modifications can be made to the process without departing from the spirit and scope thereof as described above and as defined in the following claims.

What is claimed is:

1. A process for cryogenically separating and recovering a gaseous product stream consisting of at least about 50 volume percent of helium, the balance being substantially nitrogen, from a helium-bearing natural gas received at an elevated temperature and pressure containing helium, nitrogen, methane and condensable $C_2$ and higher hydrocarbon compounds, said process comprising the steps of:

cooling said natural gas feed stream by means consisting of indirect heat exchange to condense at least a portion of the methane and a substantial portion of the condensable $C_2$ and higher hydrocarbon compounds present therein;

introducing said cooled natural gas feed stream into a first fractionation zone and therein effecting a separation of said cooled natural gas feed stream into a first liquid phase effluent stream comprised of a condensed portion of said methane and a condensed substantial portion of the condensable $C_2$ and higher hydrocarbon compounds and a first vaporous phase comprised of helium, nitrogen, a remaining balance of the methane and the condensable $C_2$ and higher hydrocarbon compounds;

withdrawing said first vaporous phase from the first fractionation zone;

subjecting said first vaporous phase withdrawn from the first fractionation zone to further cooling by means selected from the group consisting of indirect heat exchange utilizing at least one process-derived stream as a heat exchange media and expansion to condense a major portion of the remaining balance of said methane and the remaining balance of the condensable $C_2$ and higher hydrocarbon compounds present therein;

introducing said further cooled first vaporous phase into a second fractionation zone and therein effecting separation of said further cooled first vaporous phase into a second liquid phase effluent stream comprised of the condensed major portion of the remaining balance of said methane and the condensed remaining balance of the condensable $C_2$ and higher hydrocarbon compounds and a second vaporous phase comprised of helium, nitrogen and a remaining minor portion of the remaining balance of said methane;

withdrawing the second vaporous phase from the second fractionation zone;

subjecting said second vaporous phase withdrawn from the second fractionation zone to indirect heat exchange utilizing at least one process-derived stream as a heat exchange media to further cool said second vaporous phase to condense the remaining minor portion of the remaining balance of said methane and a major portion of the nitrogen therein and then to expansion to reduce the pressure thereof;

introducing said cooled and expanded second vaporous phase into a third fractionation zone and therein effecting a separation of said cooled and expanded second vaporous phase into a third liquid phase effluent stream comprising a condensed residue gas stream consisting of the condensed remaining minor portion of the remaining balance of said methane and a major portion of the nitrogen and a third vaporous phase comprising said gaseous product stream consisting of at least about 50 volume percent of helium, the balance being substantially nitrogen; and withdrawing and recovering individually from said third fractionation zone said condensed residue gas stream and said gaseous product stream.

2. A process for cryogenically separating and recovering a gaseous product stream consisting of at least about 50 volume percent of helium, the balance being substantially nitrogen, from a helium-bearing natural gas received at an elevated temperature and pressure and containing helium, nitrogen, methane and condensable $C_2$ and higher hydrocarbon compounds, said process comprising the steps of:

cooling said natural gas feed stream by means consisting of indirect heat exchange to condense at least a portion of the methane and a substantial portion of the condensable $C_2$ and higher hydrocarbon compounds present therein;

introducing said cooled natural gas feed stream into a first fractionation zone and therein effecting a separation of said cooled natural gas feed stream into a first liquid phase effluent stream comprised of a condensed portion of said methane and a condensed substantial portion of the condensable $C_2$ and higher hydrocarbon compounds and a first vaporous phase comprised of helium, nitrogen, a remaining balance of the methane and the condensable $C_2$ and higher hydrocarbon compounds;

withdrawing said first liquid phase effluent stream from the first fractionation zone;

withdrawing said first vaporous phase from the first fractionation zone;

subjecting said first vaporous phase withdrawn from the first fractionation zone to further cooling by means selected from the group consisting of indirect heat exchange utilizing at least one process-derived stream as a heat exchange media and expansion to condense a major portion of the remaining balance of said methane and the remaining balance of the condensable $C_2$ and higher hydrocarbon compounds present therein;

introducing said further cooled first vaporous phase into a second fractionation zone and therein effecting separation of said further cooled first vaporous phase into a second liquid phase effluent stream comprised of the condensed major portion of the remaining balance of said methane and the condensed remaining balance of the condensable $C_2$ and higher hydrocarbon compounds and a second vaporous phase comprised of helium, nitrogen and a remaining minor portion of the remaining balance of said methane;

withdrawing said second liquid phase effluent stream from the second fractionation zone;

withdrawing said second vaporous phase from the second fractionation zone;

subjecting said second vaporous phase withdrawn from the second fractionation zone to indirect heat exchange utilizing at least one process-derived stream as a heat exchange media to further cool second vaporous phase to condense the remaining minor portion of the remaining balance of said methane and a major portion of the nitrogen therein and then to expansion to reduce the pressure thereof;

introducing said cooled and expanded second vaporous phase into a third fractionation zone and therein effecting a separation of said cooled and expanded second vaporous phase into a third liquid phase effluent stream comprising a condensed residue gas stream consisting of the condensed remaining minor portion of the remaining balance of said methane and a major portion of the nitrogen and a third vaporous phase comprising said gaseous product stream consisting of at least about 50 volume percent of helium, the balance being substantially nitrogen;

withdrawing and recovering individually from said third fractionation zone said condensed residue gas stream and said gaseous product stream;

introducing said first and second liquid phase effluent streams into a fourth fractionation zone and therein effecting a separation of said first and second liquid phase effluent streams into a fourth liquid phase effluent stream comprising a natural gas liquids product stream consisting of a condensed minor portion of said methane and a condensed substantially portion of said condensable C2 and higher hydrocarbon compounds and a fourth vaporous phase comprising a vaporous residue gas stream consisting of a remaining balance of said methane and a remaining minor portion of the condensable C2 and higher hydrocarbon compounds; and withdrawing and recovering individually from the fourth fractionation zone said natural gas liquids product stream and said vaporous residue gas stream.

3. The process of claim 2 further comprising the steps of:

separating said condensed residue gas stream into a fifth liquid phase effluent stream consisting of from about 90 to about 100 volume percent of methane and from about 0 to about 10 volume percent of nitrogen and a fifth vaporous phase stream consisting of from about 0 to about 10 volume percent of methane and from about 90 to about 100 volume percent of nitrogen; and recovering individually said fifth liquid phase effluent stream and said fifth vaporous phase stream.

4. The process of claim 2 wherein said helium-bearing natural gas feed stream to be cooled by means of indirect heat exchange is at an initial elevated temperature ranging from about 10° C. to about 50° C. and an initial elevated pressure ranging from about 400 psig to about 4000 psig.

5. The process of claim 2 wherein said helium-bearing natural gas feed stream is cooled to a temperature ranging from about minus 20° C. to about minus 120° C.

6. The process of claim 5 wherein the cooling of said helium-bearing natural gas feed stream by means of said indirect heat exchange causes condensation of from about 1.0 to about 75.0 volume percent of said methane and from about 40.0 to about 99.0 volume percent of the condensable $C_2$ and higher hydrocarbon compounds present in said natural gas feed stream, said condensed methane and condensable $C_2$ and higher hydrocarbon compounds comprising said first liquid phase effluent stream separated in and withdrawn from the first fractionation zone.

7. The process of claim 2 wherein the first vaporous phase separated in and withdrawn from the first fractionation zone comprises from about 25.0 to about 99.0 volume percent of the methane and from about 1.0 to about 60.0 volume percent of the condensable $C_2$ and higher hydrocarbon compounds present in said natural gas feed stream.

8. The process of claim 7 wherein the first vaporous phase is further cooled to a temperature ranging from about minus 60° C. to about minus 155° C. by a reduction in pressure of said first vaporous phase by expansion in an expansion zone to a pressure ranging from about 150 to about 450 pounds per square inch gauge.

9. The process of claim 8 wherein said expanding and further cooling of said first vaporous phase causes condensation of from about 45 to about 85 volume percent of the remaining balance of the methane and from about 99 to about 100 volume percent of the remaining balance of the condensable $C_2$ and higher hydrocarbon compounds present in said first vaporous phase, said condensed methane and condensable $C_2$ and higher hydrocarbon compounds comprising said second liquid phase separated in and withdrawn from the second fractionation zone.

10. The process of claim 2 wherein said second vaporous stream is cooled to a temperature ranging from about minus 170° C. to about minus 205° C. by means of indirect heat exchange of said second vaporous stream with said condensed residue gas stream and said gaseous product stream withdrawn and recovered individually from the third fractionation zone.

11. The process of claim 10 wherein said cooled second vaporous phase is expanded to a pressure ranging from about atmospheric pressure to about 150 psig.

12. The process of claim 11 wherein said further cooling and said expansion of said second vaporous stream causes condensation of from about 99 to about 100 volume percent of the remaining minor portion of the remaining balance of said methane and from about 50 to about 100 volume percent of the nitrogen present in said second vaporous phase.

* * * * *